United States Patent [19]

Kring

[11] Patent Number: 4,578,137

[45] Date of Patent: Mar. 25, 1986

[54] CHEMICAL BATH APPARATUS AND SUPPORT ASSEMBLY

[75] Inventor: Charles J. Kring, Berkeley, Calif.

[73] Assignee: Wafab, Inc., San Ramon, Calif.

[21] Appl. No.: 572,940

[22] Filed: Jan. 23, 1984

[51] Int. Cl.[4] ..... C23F 3/02

[52] U.S. Cl. ..... 156/345; 156/627; 206/524.2; 220/445; 220/448; 422/199; 422/240

[58] Field of Search ..... 422/199, 202, 240, 102, 422/292; 156/345, 627; 134/107; 220/401, 445, 448; 206/524.1, 524.2

[56] References Cited

U.S. PATENT DOCUMENTS

| | | | |
|---|---|---|---|
| 819,765 | 5/1906 | Kiel | 206/524.2 |
| 1,276,599 | 8/1918 | Weeks | 156/637 |
| 1,899,413 | 2/1933 | Fritz | 206/524.2 |
| 2,783,195 | 2/1957 | Raynes et al. | 206/524.2 X |
| 3,095,463 | 6/1963 | Chang et al. | 156/345 |
| 3,294,603 | 12/1966 | Myers | 156/345 |
| 3,411,999 | 11/1968 | Weinberg | 156/637 |
| 3,764,116 | 10/1973 | Fuller et al. | 156/345 X |
| 4,350,553 | 9/1982 | Mendes | 156/345 |
| 4,475,977 | 10/1984 | Dunn | 156/345 |

OTHER PUBLICATIONS

The Condensed Chemical Dictionary, Tenth Ed., Van Nostrand Reinhold Co., pp. 403, 435 and 471, 1981.

*Primary Examiner*—Barry S. Richman
*Assistant Examiner*—Brion P. Heaney
*Attorney, Agent, or Firm*—Manfred M. Warren; Robert B. Chickering; Glen R. Grunewald

[57] ABSTRACT

A chemical bath apparatus is disclosed in which an open topped beaker having a heater mounted to the exterior wall thereof is supported in an open topped surrounding housing or shell by a support assembly, the beaker being in spaced relation to the shell. The support assembly includes a sleeve mounted in sealed relation around the heater so as to isolate the same from corrosive fumes and a resilient pad extending over a substantial area of the bottom wall of the beaker for support of substantially the entire weight of the beaker and chemical substance through the bottom wall. Vent openings for convection cooling between the shell and sleeve are also provided.

7 Claims, 4 Drawing Figures

CHEMICAL BATH APPARATUS AND SUPPORT ASSEMBLY

BACKGROUND OF THE INVENTION

The present invention relates, in general, to chemical bath apparatus and, more particularly, to high temperature acid baths of the type used for etching and stripping semiconductor devices.

In the manufacturer of semiconductor devices it is quite common to employ a manufacturing technique in which semiconductor wafers are etched in an acid bath. The acid bath apparatus commonly employed for this purpose is a relatively rectangular quartz glass vessel or beaker which has a heating coil or blanket-type heater affixed to the outside of the beaker and which is supported and mounted in a surrounding housing or shell. Typical of such prior art devices is the chemical bath apparatus disclosed in U.S. Pat. No. 4,350,553.

Such chemical baths usually employ a highly corrosive acid, such as sulphuric acid, which is heated to a temperature on the order of about 150 degrees C. The heated acid predictably produces highly corrosive fumes which, together with any splash or spillage as a result of inserting or removing semiconductor wafers, can rapidly corrode and destroy the heater mounted to the outside of the beaker. In addition to destruction of the heater, which can be costly, corrosion of the heater can also create extremely hazardous conditions.

Accordingly, the acid bath apparatus of U.S. Pat. No. 4,350,553 includes a structure in which the beaker is supported from the surrounding housing or shell on a seal which resists the passage of fumes and spillage down between the housing and beaker to the heating element. Additionally, the bath apparatus of U.S. Pat. No. 4,350,553 includes a nitrogen purging system which is used to pressurize the chamber between the beaker and the supporting housing so that acid splash and acid vapor do not reach the heating element.

The acid bath apparatus of U.S. Pat. No. 4,350,553 employs a seal between the horizontal extending lip on the acid beaker and the surrounding supporting housing. The entire weight of the beaker and acid contained therein is, therefore, supported by the lip of the beaker. In large acid baths, this weight can be in the order of 50 to 60 pounds, placing a substantial stress on the beaker. Since the beakers which are employed in prior art acid baths have been quartz glass beakers, they inherently tend to be somewhat fragile and susceptible to stress-induced cracking. The problem of stresses in acid bath beakers is further aggravated by heating of the beaker, which induces thermal stress. As will be appreciated, fracture or failure of the beaker lip upon support and heating of in excess of ten liters of sulphuric acid also can result in a very hazardous spillage of the acid.

Another approach which has been taken in connection with heated chemical baths is to fill the space between the support shell and quartz beaker with rock wool. This approach also has been found to have drawbacks, namely, the rock wool is not impervious to acid and it tends to support the beaker unevenly. Accordingly, there can be hard spots in the rock wool which will produce very substantial stress concentrations that will be aggravated upon heating of the beaker. More over, if there is uneven insulation, a hot spot can occur which will degrade the polypropylene shell. The result, again, can be failure of the fragile quartz glass beaker and/or deterioration of the rock wool to a degree which will subject the heater element to corrosive fumes.

Typical of other chemical bath apparatus are the devices of U.S. Pat. Nos. 3,411,999, 3,294,603, 3,095,463 and 1,276,599. Such apparatus, however, employ flange support for the beaker (U.S. Pat. No. 3,411,999), submersed heat transfer means and a complex multi-tank structure (U.S. Pat. No. 3,294,603), a discrete brick liner for a rubber coated steel vessel that is coupled to an external heat exchanger (U.S. Pat. No. 3,095,463), and a simple electrolysis bath (U.S. Pat. No. 1,276,599). Such prior art chemical bath apparatus inherently induce stress concentrations in the glass beaker or are not well suited for use as a semiconductor wafer etching bath.

OBJECTS AND SUMMARY OF THE INVENTION

A. Objects of the Invention

Accordingly, it is the object of the present invention to provide a chemical bath apparatus which is formed for even uniform support of the relatively fragile chemical containing beaker and yet provides a seal isolating the heater for the bath from fumes and chemical splash or spillage.

It is another object of the present invention to provide a chemical bath apparatus in which the vessel containing the chemical substance is supported in a manner minimizing the stress concentration in the vessel as a result of weight of the chemical substance and the vessel.

It is a further object of the present invention to provide a chemical bath apparatus which is more effective in preventing migration of corrosive fumes and chemicals to the heating element used to heat the bath.

Another object of the present invention is to provide a chemical bath apparatus which is relatively simple and inexpensive to construct, is more durable, and will increase the effective life of the relatively fragile quartz glass heating beaker and heating element.

Still a further object of the present invention is to provide a chemical bath apparatus in which the temperature of the bath can be readily controlled and heat outside the bath can be effectively dissipated to enhance and extend the life of the materials used in supporting the chemical bath.

The chemical bath apparatus of the present invention has other objects and features of advantage which will become apparent from and are set forth in more detail in the accompanying drawing and the following description of preferred embodiment.

B. Summary of the Invention

The chemical bath apparatus of the present invention includes an open topped vessel or beaker formed with a continuous wall for containment of a chemical substance in the vessel during heating, heater means mounted to the exterior wall of the beaker, an open topped shell extending around the beaker in spaced relation thereto, and support and seal means supporting the beaker with respect to the shell and substantially sealing and isolating the heater from corrosive fumes produced upon heating of the chemical substance in the beaker. The improvement in the chemical bath apparatus of the present invention comprises, briefly, the support and seal means being provided by a sleeve extending around and enclosing the heater and mounted in sealed relation to the exterior wall of the beaker peripherally of the heater, with the sleeve being imperforate and formed of a material which is high temperature resistant and corrosion resistant, and resilient pad means positioned between the shell and the beaker over a substantial area of the bottom wall of the beaker for resilient support of a substantial portion of the weight of the beaker and chemical substance therein through the bottom wall of the beaker. Additionally, the bath apparatus preferably includes vent openings in the shell positioned for convection cooling of the exterior surface of the sleeve and a sealing ring and splash barrier flange which further assists in isolating the heater from fumes generated by the bath.

DESCRIPTION OF THE PREFERRED EMBODIMENT

Figure 1:
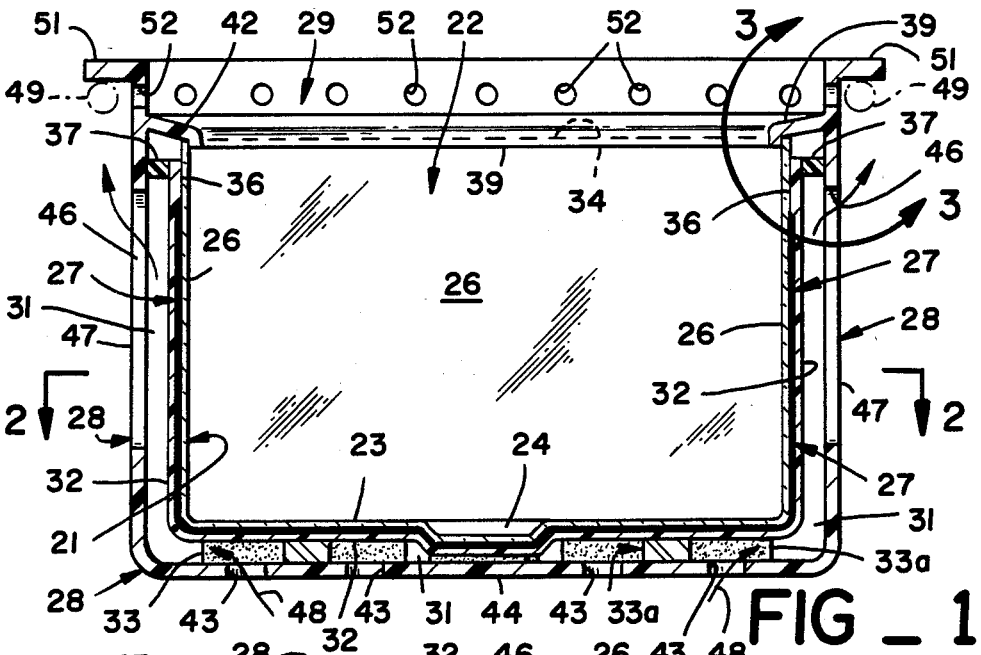
FIG. 1 is a side elevational view in cross-section of a chemical bath apparatus constructed in accordance with the present invention.

As is common in the prior art, the chemical bath apparatus of the present invention includes a glass, preferably quartz glass, beaker 21 which is preferably formed as a generally rectangular tank with an open top 22. Formed in the bottom wall 23 of the beaker is a stirring well 24 dimensioned for receipt of a magnetic stirring element (not shown). Beaker 21 is formed with a continuous side wall 26 and a continuous bottom wall 23 for containment of the chemical substance to be heated.

In order to effect heating of chemicals placed in beaker 26, the chemical bath apparatus further includes heater means, generally designated 27, mounted to the exterior of side walls 26, and preferably to the exterior of bottom wall 23, of the beaker. Heater means 27 can be provided as a blanket-type resistant heater in which the heating coils are etched in a foil or provided by a ribbon-like wire. Such units are commercially available, well known in the industry and will not be described in further detail herein.

As is also typical in the prior art chemical bath apparatus, the chemical bath apparatus of the present invention includes an exterior housing or shell, generally designated 28, which substantially surrounds the sides and bottom of beaker 21 with heater means 27 mounted thereto. Shell 28 is also formed with an open top 29 permitting access to the interior of beaker 21. The shell 28 is generally dimensioned so that it surrounds the beaker in relatively spaced apart relations thereto so as to define a cavity 31 between the beaker and shell.

The chemical bath apparatus of the present invention further includes means for supporting the beaker from the shell and sealing the heater from corrosive fumes produced upon heating of the chemical contained in the beaker. As thus far described, the chemical bath apparatus of the present invention includes elements which are broadly known in the prior art, such elements and components are not, as thus far described, regarded as a novel portion of the present invention.

In order to reduce the stress on quartz beaker 21 and to more effectively seal and isolate heater 27 from corrosive fumes, the improved chemical bath apparatus of the present invention includes a support and seal assembly having a sleeve means 32 mounted to extend around and enclose heater 27 and mounted in sealed relation to the exterior of the walls of the beaker peripherally of the heater. Seal means 32 is imperforate and formed of a material which is high temperature resistant and corrosion resistant. Additionally, the support and seal assembly of the improved chemical bath apparatus of the present invention includes resilient, corrosion resistant, pad means 33 positioned between shell 28 and beaker 21 over a substantial area of the bottom wall 23 of the beaker for resilient support of a substantial portion of the weight of the beaker with the chemical substance (not shown) to be heated positioned therein.

Thus, instead of attempting to seal the space between shell 28 and beaker 21 to protect the heater, as has been the approach in the prior art, the apparatus of the present invention seals the heater to the beaker and permits, or only resists (but does not seal), the entrance of fumes and the like between the shell and the sleeve.

Figure 2:
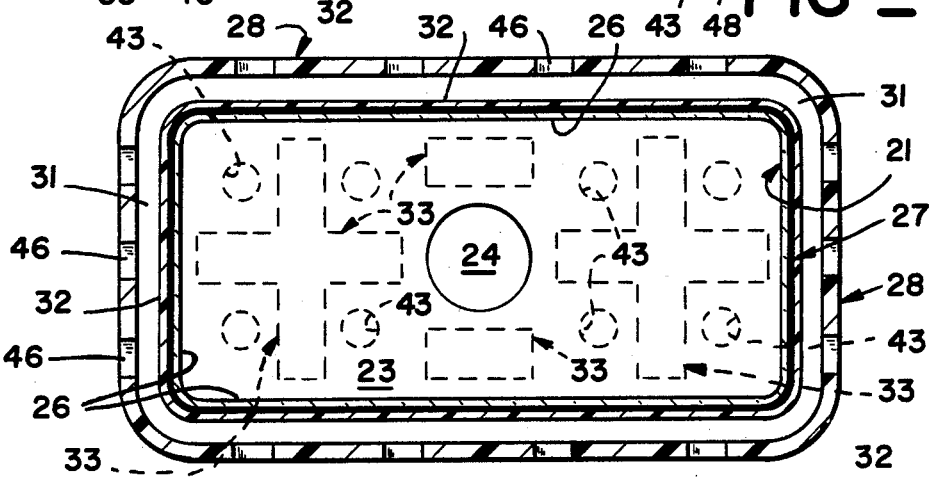
FIG. 2 is a top plan view in cross-section taken substantially along the plane of line 2—2 in FIG. 1.

As best may be seen in FIG. 2, pad means 33 is preferably formed by a plurality of discrete pads positioned relatively uniformly over the area of bottom wall 23 of the beaker. Beaker 21 as shown in the drawings is not formed with a lip or flange around the upper edge 34 thereof, and in the chemical bath apparatus of the present invention no attempt is made to support any of the weight of the beaker and acid bath through a lip structure, or for that matter, through side walls 26. Instead, pad means 33 of the present invention preferably resiliently supports the entire weight of the beaker through bottom walls 23.

While it would be possible to provide pad means 33 which extends over the entire area of bottom wall 23, pad means 33 of the present invention is, instead, formed for relatively uniform support of a substantial area of the bottom wall, but voids or spaces 31 are preferably provided to enable venting between the shell and beaker, in a manner which will be more fully described hereinafter.

A high temperature resistant and corrosion resistant material suitable for forming sleeve means 32 is a fluoroelastomer of the type used in gaskets and seals such as the gasket employed to create a seal between the beaker and housing or shell in U.S. Pat. No. 4,350,553. Such fluoroelastomers are sold under the trademark VITON by DuPont and the trademark FLUOREL by 3M Company, and they are also used to form diaphragms, tubing and coated fabrics. Such fluoroelastomers are well known for high temperature resistance and resistance to steam, hot water, and chemicals. Sleeve 32 is preferably formed of a fluoroelastomer as a cup-shaped member having a slight interference fit with respect to beaker 26. The fluoroelastomer sleeve 32 can be urged over the beaker with heater 27 mounted to the ouside wall of the beaker by a room temperature vulcanizing (RTV) silicon adhesive, or the sleeve can be used to secure the heater in place on the beaker wall. Whether or not an adhesive is used to secure heater 27, the sleeve encloses the entire heater. Sleeve 32 preferably includes a band 36 which extends around the upper edge of the beaker or peripherally of the heater so as to seal the heater against entry of corrosive fumes between the beaker and the sleeve. To the extent required it is also possible to seal sleeve 32, and particularly band 36, to beaker 21 by means of a (RTV) silicon adhesive.

Instead of or in addition to applying an adhesive at band 36 of the heater sleeve or bootie 32 the chemical bath apparatus of the present invention additionally preferably includes a resilient tightening ring means 37 which is mounted in interference fit with and around the outside of sleeve 32 at the upper edge or band 36 proximate the top of the sleeve. Tightening ring 37 not only assists in sealing or tightening sleeve 32, but it also is formed to extend to and engage shell 28 so as to maintain the shell and the beaker in a fixed space relation to each other. Thus, the tightening ring both assists in sealing sleeve 32 and assists as a spacer element. It is not preferred that there be a tight or interference fit between tightening ring 37 and shell 28.

In the preferred form of the bath of the present invention, both tightening ring 37 and pad means 33 are formed of a resilient corrosion resistant material such as ethylene-propylene-diene monomer (EPDM) based elastomers. EPDM elastomers are available through numerous manufacturers and have a substantial degree of corrosion resistance and temperature resistance, although not as great a resistance as fluoroelastomer. As will be described more fully hereinafter, the EPDM pads and sealing rings are not subjected to the same high temperature as is sleeve 32. Alternatively, however, it is possible to form pad means 33, and even tightening ring 37 integrally with sleeve 32 thus the pad 33*a* shown in the right side of FIG. 1 has been integrally formed with sleeve 32. A primary disadvantage of such a structure is that the high temperature and high corrosion resistant fluoroelastomer sleeve is a more costly material, and such cost is not required to effect either resilient support or sealing of the sleeve to the beaker. A pad thickness of about four times the thickness of the beaker walls, particularly when combined with the fluoroelastomer sleeve which has some resiliency, will provide sufficient support for beaker 21.

Figure 3:
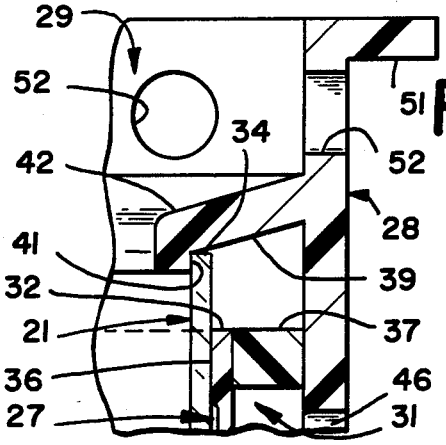
FIG. 3 is an enlarged, fragmentary, side elevational view of the portion of the acid bath apparatus of the present invention enclosed by line 3—3 in FIG. 1.

Additionally, it is preferable that the chemical bath apparatus of the present invention be formed with a splash barrier flange 39 which extends inwardly from shell 28 above tightening ring 37 to position over the upper edge 34 of beaker 21. As best may be seen in FIG. 3, splash barrier flange 39 preferably overhangs the upper edge 34 of beaker 21. Most preferably, the upper surface 42 of splash barrier flange 39 is formed as an inwardly and downwardly sloping surface so that fumes, condensate, splashing and the like will drain back into the beaker. This splash shield could alternatively consist of a quartz flange, possibly welded to the beaker 21.

In light of the cost of high temperature resistant and corrosion resistant sleeves, such as sleeve 32, is further a feature of the present invention to provide venting for the chemical bath apparatus which will provide effective heat transfer away from sleeve 32. Thus shell 28 is preferably formed with vent openings positioned for convection cooling of the exterior surface of sleeve 32. Such vent openings include at least one, and preferably a plurality of openings, 43 in the bottom wall 44 of shell 28. Additionally, the vent openings include at least one, and preferably a plurality, of slot-like openings 46 in the side wall 47 of the shell. Pad means 33 can be seen to be formed for the flow of air into openings 43, as indicated by arrows 48, and upwardly by convection between sleeve 32 and shell side walls 47 for a discharge out openings 46. In use, the chemical bath apparatus of the present invention is usually supported on rods or support members 49 (shown in phantom in FIG. 1) which engage flange 51 on the upper edge of the shell. Thus, circulation of air beneath the shell and into opening 43 is readily accomplished.

Convection cooling of sleeve 32 has several benefits. First, there is a convection current which tends to oppose the migration of corrosive fumes into the void 31 between the shell and sleeve. Secondly, cooling of the sleeve enables the sleeve to be relatively thin, for example, approximately the thickness of the wall of beaker 21, for example, $\frac{1}{8}$ inch (3 millimeters). Additionally, convection cooling between the shell and sleeve also affords better temperature control than would be the case if the entire void 31 were filled with a highly effective insulator. Heat dissipation provides a temperature gradient or an over damped system that allows more precise control of the temperature of the acid bath. Highly insulated systems are under damped and tend to overrun temperature control levels. Thus, while there is heat loss as a result of lack of insulation and heat dissipation through convection, such an over damped system enables more precise control of the acid bath temperature, which is highly desirable in a semiconductor etching process.

It is possible to form the surrounding housing or shell 28 of numerous corrosion resistant materials, but most preferably the shell is formed of polypropylene. A cup-shaped shell can be roto-molded with annular flange 51 and splash barrier 39 secured, for example by hot gas welding, to the basic shell. The shell also preferably includes a plurality of openings 52 which affords circulation of air over the top surface of the beaker.

Figure 4:
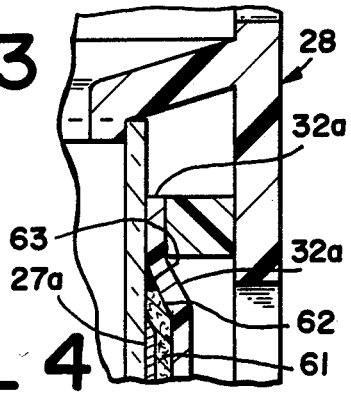
FIG. 4 is an enlarged, fragmentary, side elevational view corresponding to FIG. 3 of a modified form of the invention.

In FIG. 4 an alternative embodiment of the acid bath apparatus of the present invention is shown in which a layer 61 of thermally insulating material is interposed between heater 27 and sleeve 32*a*. Layer 61 can be formed of rock wool, or equivalent thermally insulating material, which has the effect of preventing heat loss so as to minimize energy consumption, and to increase the life of sleeve 32*a*. While rock wool is susceptible to corrosive degradation by acid fumes, sleeve 32*a* isolates not only heater 27*a*, but also insulating layer 61. In the preferred form, rock wool layer 61 is about $\frac{1}{8}$ inch to $\frac{1}{4}$ inch thick and is faired at 62 and sealed by an RTV adhesive at 63 to provide a smooth transition over which sleeve 32*a* can be mounted.

The chemical bath apparatus of the present invention provides relatively stress-free support of the fragile quartz beaker and further effectively isolates the heater from acid fumes.

What is claimed is:

1. In a chemical bath apparatus including an open topped beaker formed with a continuous bottom wall and a continuous side wall for containment of a chemical substance in said beaker during heating, heater means mounted to the exterior of at least one of said bottom wall and said side wall for heating of said chemical substance therethrough, said heater means terminating in a heater periphery, open topped shell means having a bottom wall and a side wall, said shell means extending around said beaker and said heater means, spacing means between said shell means and said beaker for maintaining said shell means in spaced relation to said side wall of said beaker to provide a space between said side wall of said beaker and said shell means, and a support and seal assembly supporting said beaker with respect to said shell means and substantially sealing and isolating said heater means from corrosive fumes produced upon heating of said chemical substances in said beaker, wherein the improvement in said chemical bath apparatus comprises:

said support and seal assembly including:

(a) sleeve means extending around and enclosing said heater means and being mounted in sealed relation to the exterior of said beaker at locations extending beyond said heater periphery, said sleeve means being imperforate and formed of a material which is highly temperature resistant and corrosion resistant to provide a substantially fume impervious barrier positioned and sealed to said beaker at said locations beyond said heater periphery; and (b) resilient, corrosion resistant, pad means positioned between said shell means and said beaker over a substantial area of said bottom wall of said beaker to provide resilient vertical support of substantially the entire weight of said beaker with said chemical substance therein through said bottom wall of said beaker and for maintaining said bottom wall of said shell means in spaced relation to said bottom wall of said beaker.

2. Chemical bath apparatus as defined in claim 1 wherein the improvement further comprises, said beaker is formed of quartz glass, and said bottom wall is substantially flat;

said sleeve means is formed as a cup-shaped sleeve substantially covering the side wall and bottom wall of said beaker, said sleeve means being formed of a fluoroelastomer, having a thickness about equal to the thickness of the walls of said beaker; and said pad means is formed from an ethylene-propylene-diene monomer based elastomer having a thickness about equal to four times the thickness of the walls of said beaker.

3. Chemical bath apparatus as defined in claim 1 wherein the improvement further comprises, said shell means being formed with vent openings including at least one opening in said bottom wall of said shell means, and at least one opening in said side wall of said shell means, said opening in said side wall of said shell means being in fluid communication with said space between said shell means and said side wall of said beaker;

said pad means is formed and positioned so as to permit the entry and flow of air into said opening in said bottom wall; and said pad means defining a flow passage which permits fluid communication between said opening in said bottom wall of said shell means and said space between said shell means and said side wall of said beaker.

4. Chemical bath apparatus as defined in claim 3 wherein the improvement further comprises, said bottom wall of said shell means is provided with a plurality of spaced apart openings, said side wall of said shell means is provided with a plurality of slot-like openings, and said pad means defines fluid passages which permit fluid communication between all of said plurality of openings in said bottom wall and said spaces between said shell means and said side wall of said beaker.

5. Chemical bath apparatus as defined in claim 1 wherein the improvement further comprises, said spacing means comprises a tightening ring means mounted in interference fit with and around the outside of said sleeve means proximate an upper edge of said sleeve means to assist in effecting a seal between said sleeve means and said beaker.

6. Chemical bath apparatus as defined in claim 5 wherein the improvement further comprises, said tightening ring is further formed to slidably engage said shell means to maintain said shell means at a spaced distance from said beaker.

7. Chemical bath apparatus as defined in claim 5 wherein the improvement further comprises, said side wall of said beaker has an upper edge and said shell means is formed with splash barrier flange means extending inwardly from said shell above said tightening ring and extending over and engaging said upper edge of said beaker defining the open top thereof.

* * * * *